US009302505B2

(12) United States Patent
Toia et al.

(10) Patent No.: US 9,302,505 B2
(45) Date of Patent: Apr. 5, 2016

(54) MEDIA JAM CLEARING

(71) Applicant: Hewlett-Packard Development Company, L.P., Houston, TX (US)

(72) Inventors: Alexander Toia, Vancouver, WA (US); Luke P. Sosnowski, Camas, WA (US); Michael James Rode, Vancouver, WA (US); Richard Scott Smith, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/418,773

(22) PCT Filed: Sep. 27, 2012

(86) PCT No.: PCT/US2012/057481

§ 371 (c)(1),
(2) Date: Jan. 30, 2015

(87) PCT Pub. No.: WO2014/051583

PCT Pub. Date: Apr. 3, 2014

(65) Prior Publication Data

US 2015/0266314 A1 Sep. 24, 2015

(51) Int. Cl.
*B41J 11/00* (2006.01)

(52) U.S. Cl.
CPC ..... *B41J 11/006* (2013.01)

(58) Field of Classification Search
CPC .. B41J 11/0065; B41J 11/007; B41J 11/0085; B41J 11/06; B41J 13/103
USPC ..... 347/14, 16, 101, 104; 271/256, 258.01
See application file for complete search history.

(56) References Cited

U.S. PATENT DOCUMENTS

| | | | | |
|---|---|---|---|---|
| 4,878,087 | A * | 10/1989 | Sakai et al. | 399/20 |
| 5,024,431 | A * | 6/1991 | Shimizu et al. | 271/263 |
| 6,007,062 | A * | 12/1999 | Choo et al. | 271/258.01 |
| 7,896,344 | B2 | 3/2011 | Nakada et al. | |
| 2004/0213590 | A1 * | 10/2004 | Schroath et al. | 399/21 |
| 2007/0134008 | A1 * | 6/2007 | Gudaitis et al. | 399/21 |
| 2007/0242963 | A1 * | 10/2007 | Saikawa et al. | 399/21 |
| 2008/0048390 | A1 * | 2/2008 | Gutierrez-Vazquez et al. | 271/256 |

FOREIGN PATENT DOCUMENTS

| | | | |
|---|---|---|---|
| CN | 1169919 | A | 1/1998 |
| CN | 101639644 | A | 2/2010 |
| CN | 101758663 | A | 6/2010 |

(Continued)

OTHER PUBLICATIONS

International Search Report & Written Opinion received in PCT Application No. PCT/US2012/057481, Apr. 29, 2013, 12 pages.

*Primary Examiner* — Manish S Shah
*Assistant Examiner* — Roger W Pisha, II
(74) *Attorney, Agent, or Firm* — Fabian Van Cott

(57) ABSTRACT

A method for media jam clearing includes detecting a media jam with sensor in the printer, in which the media jam comprises a sheet of media stuck in a media path of the printer. The method further includes monitoring for user action that alters the mechanically alters the state of the printer and detecting a user action that mechanically alters the state of the printer. In response to detection of the user action, the printer automatically attempts to clear the media jam.

15 Claims, 9 Drawing Sheets

(56) References Cited

FOREIGN PATENT DOCUMENTS

| | | | |
|---|---|---|---|
| CN | 101758664 | A | 6/2010 |
| CN | 102218941 | A | 10/2011 |
| JP | 11109801 | A | 4/1999 |
| JP | 2006095945 | A | 4/2006 |
| JP | 2006218637 | A | 8/2006 |
| JP | 2011173432 | A | 9/2011 |
| KR | 100184576 | B1 | 5/1999 |

* cited by examiner

MEDIA JAM CLEARING

BACKGROUND

Printers produce a representation of electronic data on a physical media such as paper or transparency film. Printers can print on variety of media types and sizes. Printers include a variety of mechanisms, such as pickup mechanisms, rollers, shields, duplexers and platens to form a media path through the printer and to control the media as it moves through the media path. Occasionally, a sheet of media may become jammed as it moves through the media path. This can render the printer inoperative until the media jam is cleared.

BRIEF DESCRIPTION OF THE DRAWINGS

The accompanying drawings illustrate various examples of the principles described herein and are a part of the specification. The illustrated examples are merely examples and do not limit the scope of the claims.

Throughout the drawings, identical reference numbers designate similar, but not necessarily identical, elements.

DETAILED DESCRIPTION

Media can become jammed in the media path of a printer for a variety of reasons. When a media jam occurs, it typically obstructs the flow of additional media through the printer. Thus, the media jam is cleared before printing can resume. Most media jams can be easily resolved, either by the printer itself or by a user observing the location of the media jam and extracting the jammed media from the printer. However, when access to the jam location is restricted or the media is tightly gripped by rollers it can be difficult to remove the media. If a user grasps the media and pulls, the tightly gripped media may rip, leaving a portion of the media stuck in the media path.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an example" or similar language means that a particular feature, structure, or characteristic described in connection with the example is included in at least that one example, but not necessarily in other examples.

Figure 1:
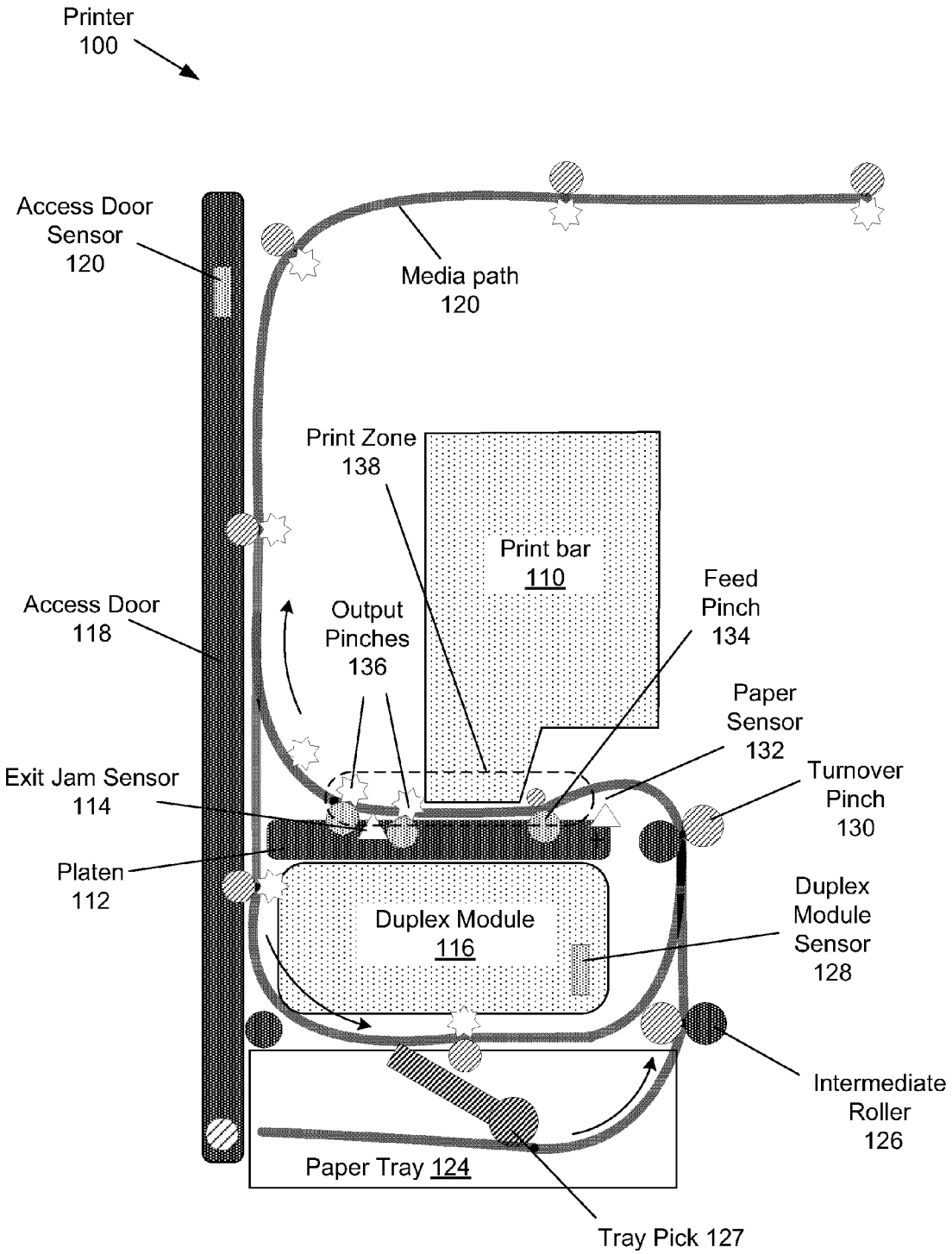
FIG. 1 is a diagram of a printer and a media path through the printer, according to one example of principles described herein.

FIG. 1 is a diagram of a printer (100) and a media path (120) through the printer. The printer shown in FIG. 1 is only one example and is provided to illustrate the principles described herein. The principles could be applied to a variety of printers with different configurations. For example, the printer may be a web-fed printer, a sheet fed printer, copier, or multifunction printer. The printing technology used by the printer may be ink-jet, laser, sublimation, solid ink or other printing technology. The printer may have any of a number of configurations, including multiple media paths that draw from a number of paper trays.

In this example, the printer (100) is an ink-jet printer with a page-wide print bar (110). The print bar (110) is configured to print the entire width of the media as it passes under the print bar. Using a page-wide print bar can produce a number of advantages including high printing speeds, precise placement of ink onto the substrate, and accurate registration within images.

In this example, the media path (120) starts in a paper tray (124). The sheets of media are placed in the paper tray (124) and extracted as needed by a tray pick (127). The intermediate rollers (126) accept the media and pass it upward to a turnover pinch (130). The media then passes over a paper sensor (132), through feed pinch (134) and into the print zone of the printer. The print bar (110) deposits the desired image onto the upper face of the media as it passes between the platen (112) and the print bar (110). Output pinches (136) move the media out of the print zone and upward out of the printer. In this implementation, a print zone exit jam sensor (114) is located between two of the output pinches (136).

If the user has selected a two sided print, the duplex module (116) reverses the sides of the media to present the opposite side of the media to the print bar for printing. This can be accomplished by moving the entire sheet of media through print zone to print the first side of the media and then reversing the media direction to bring the media down under the duplex module and back up into the print zone with the opposite face of the media facing upwards.

Media jams that occur in easily accessible areas of the media path are relatively trivial to clear. For example, if a media jam occurs in the paper tray (124) the user can remove the paper tray, see the jam and pull on the media to remove it. However, media jams in other locations, such as in the print zone (138) can be more difficult to remove. The media is tightly controlled in the print zone to ensure accurate positioning and velocity of the media as it is printed. To achieve the desired level of control, the media may be gripped by multiple rollers sets of opposing rollers ("pinches"). One or more of the rollers in each pinch may be powered and controlled by connection to an electrical motor. In some situations, the media may be gripped by two or more pinches. To extract media from a pinch, the user has to exert enough force on the media to rotate the rollers and the attached electrical motor. Where multiple pinches are gripping the media, it can be extremely difficult to exert enough force to rotate the rollers and back drive the motors without tearing the media. When media is torn, the consequences of the jam are magnified. The media is more difficult to remove, more irregularly shaped, and stray pieces of the media may undesirably migrate into service areas, transmission areas, and media path of the printer.

Additionally, media jams that occur in areas with restricted access can be difficult to remove because it can be difficult to see and manipulate the jammed media. For example, an area with restricted access may be an area that it is difficult to visually determine if there is a sheet of media that is jammed. In other cases, the area with restricted access in a printer can be an area is obstructed or too small for the user to insert their hand or fingers to grasp/remove the jammed media.

One example of an area with restricted access is the print zone (138) of the printer illustrated in FIG. 1. In the print zone (138), the clearances between the platen (112), print bar (110), feed pinch (134), output pinches (136) are particularly tight to provide the desired paper control and positioning.

Figure 2:
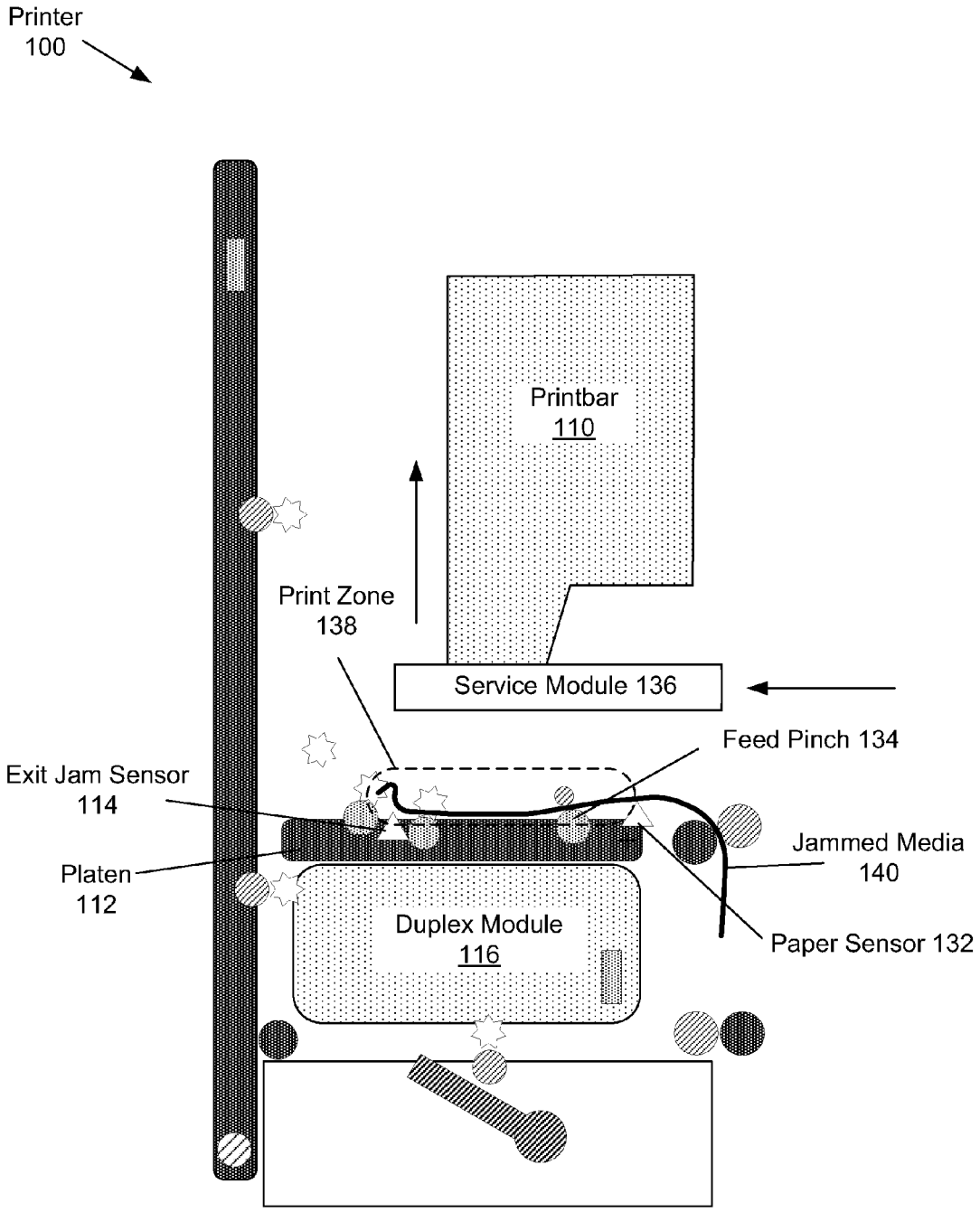
FIG. 2 is a diagram of a printer with a media jam in the print zone, according to one example of principles described herein.

FIG. 2 is a diagram of the printer (100) with a sheet of media (140) jammed in the print zone (138). There are number of detectors that can be used to automatically detect a media jam. For example, this printer includes a paper sensor (132) and print zone exit jam sensor (114). When the media is not sensed in an expected location or is sensed in a location where it is not expected, the printer uses an algorithm to determine if a media jam has occurred and the location of the jam.

In FIG. 2, the printer has sensed a jam in the print zone. The printer does not, in this example, attempt to automatically clear the jam itself. Instead, the printer stops printing, broadcasts an error message that notifies the user of the jam, and goes into a standby mode to wait for the user to address the jam. The error message may be sent electronically to the user, may be displayed on the control panel of the printer, may include an audible notification, etc. The printer goes into a standby or suspend mode by lifting the print bar and moving a service module under the print bar to cap the ink jet the on the bottom surface of the print bar. This prevents the ink from drying in the ink-jet nozzles in the die and potentially causing a degradation of print quality. The printer can also take a variety of other actions such as reducing power consumption and disengaging motors from rollers. The printer then monitors for user action that will trigger it to take automatic jam clearing actions or to assist the user in extracting the jammed media.

Figure 3:
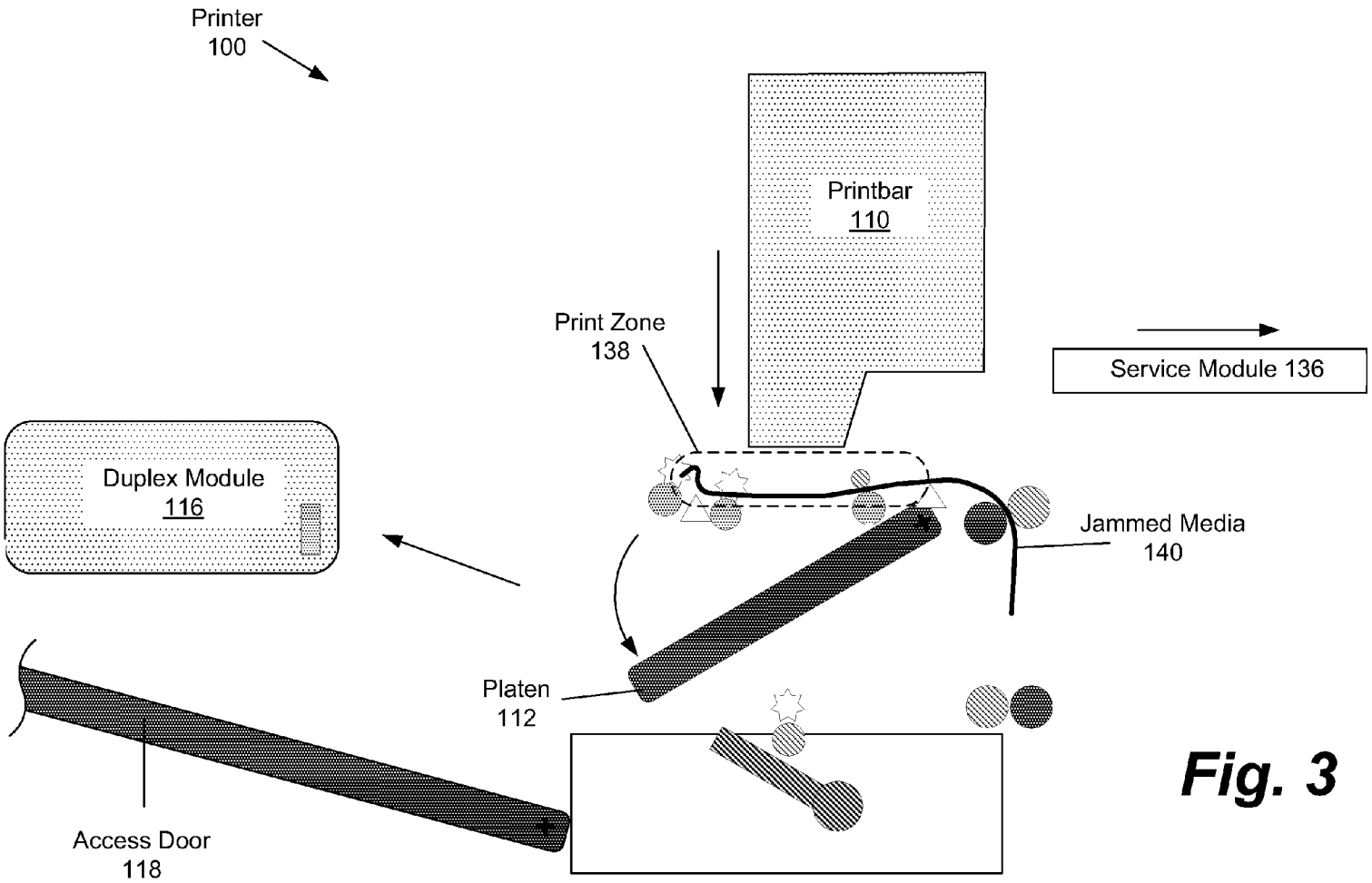
FIG. 3 is a diagram of automated and user actions that can be taken to clear the media jam, according to one example of principles described herein.

FIG. 3 is a diagram of user actions to clear the media jam that may trigger automated jam clearing processes within the printer (100). The user can take a variety of actions to clear a jam. In most cases, the printer can locate the media jam and will display specific instructions and graphics showing the user how to accomplish the instructions. In this example, the printer has detected a print zone media jam and instructed the user to open the access door (118). An access door sensor (120, FIG. 1) allows the printer to detect when the user has opened the access door (118). The printer can then take a number of automatic actions that are triggered by the user's action or actions. In this example, the printer uncaps the print bar (110) and removes the service module (136). The print bar (110) is then lowered. The reason for lowering the print bar is because the lower surface of the print bar forms part of the media path and blocks the media from leaving the media path and entering service areas of the printer.

The user can then be instructed to remove the duplex module and optionally lower the platen after the duplex module is removed. Depending on the user actions, the printer can then take automatic actions to clear the jam or assist the user in manually removing the jammed media. These user actions and conditions that are prerequisite to taking one or more of these automatic actions by the printer are described in the flow charts below.

Figure 4A:
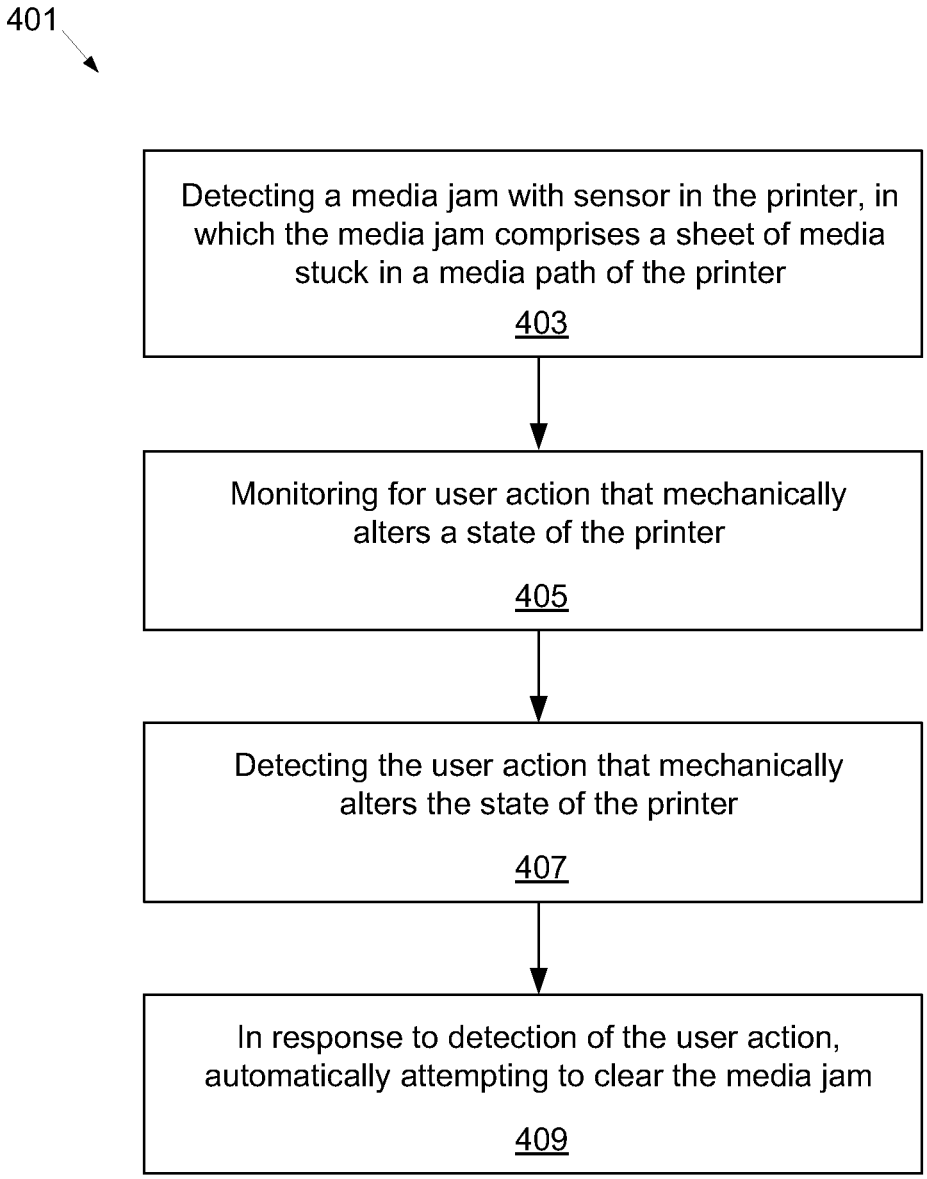
FIGS. 4A and 4B are flowcharts describing user triggered media jam clearing, according to one example of principles described herein.

FIG. 4A is flowchart describing a general method (401) for media jam clearing. The method includes detecting a media jam in a media path with sensor in the printer (403). The sensor generates an output that indicates that a jam has been detected. A second sensor monitors for user action that mechanically alters a state of the printer (405). When the user action occurs, the second sensor detects the user action (407) and generates an output that indicates that one or more user actions have occurred. In response to detection of the media jam and user action, the printer automatically attempts to clear the media jam (409) by activating one or more electrical motors or actuators.

Figure 4B:
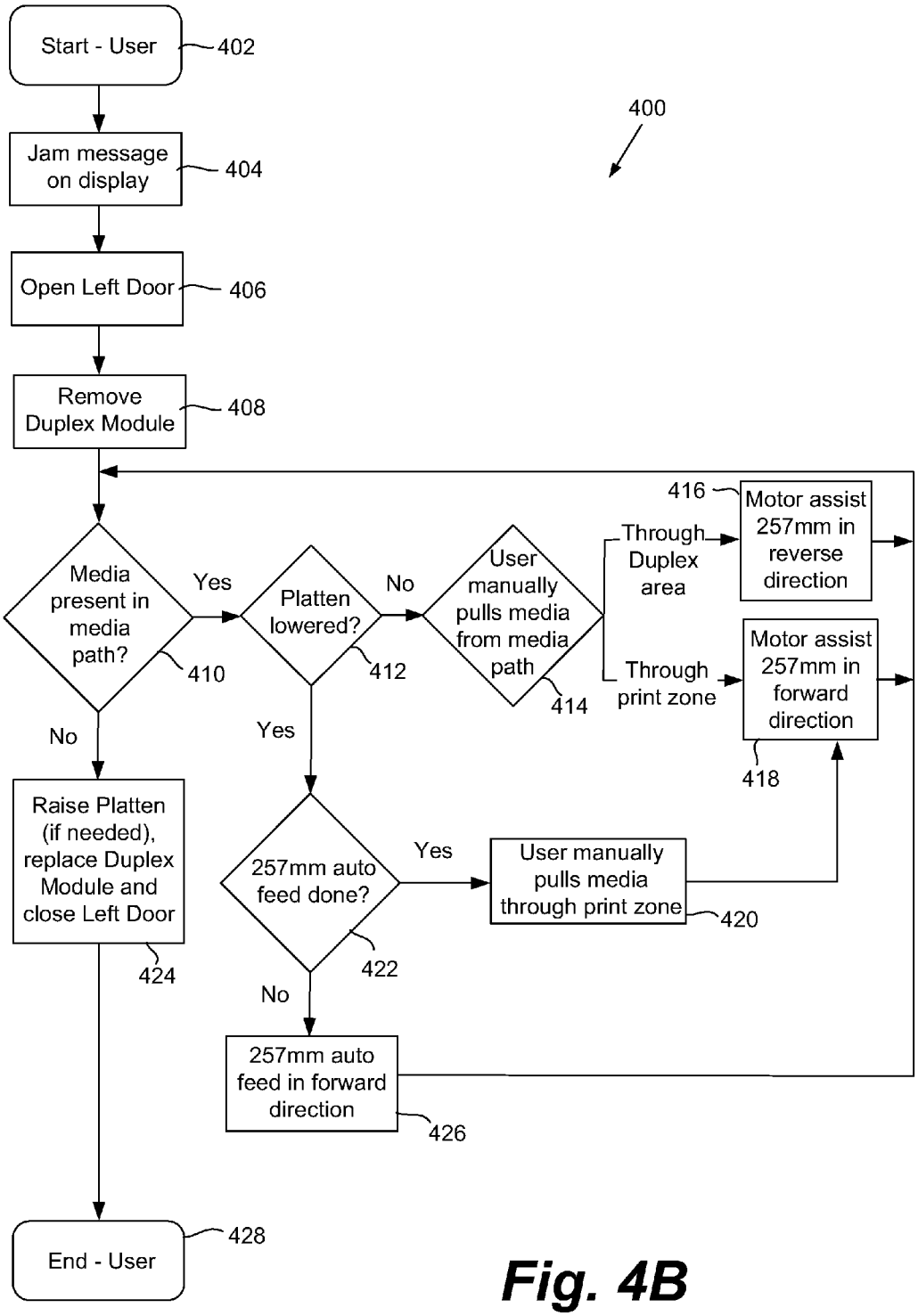

FIG. 4B is flowchart of a method (400) focusing on user action in clearing a media jam in the print zone. The method starts (402) when jam is detected and the printer displays a message on the printer display (404). The message may include a notification that a jam has occurred and provide step-by-step instructions to the user for how to clear the jam. In this example, the user is instructed to open the left access door (406). As discussed above, an access door sensor allows the printer to determine when the user complies with this instruction. The user is next instructed to remove the duplex module (408). The user and/or printer then determine if there is media present in the paper path (410). If there is paper in the media path, the printer determines if the platen is raised or lowered (412). If the platen is raised (412, "No"), the user pulls the media from the paper path (414). The printer detects if the paper is pulled in through the duplex area or through the print zone. If the paper is pulled by the user from the duplex area, the printer reverses the direction of jammed media to push it backwards into the duplex area. This assists the user in removing the jam by lowering the amount of force the user has to exert on the paper to pull it backwards into the duplex area. In one example, when the print is printing on A4 or 8.5×11 paper, the printer uses a motor assist to move the rollers/paper approximately 257 mm (10 inches) in the reverse direction (416). If the user attempts to pull the media through the print zone, the printer applies motor assist to move the jammed media 257 mm (10 inches) forward through the print zone (418). These distances can be adjusted to any appropriate distance depending on the size of media, location of the jam, and other factors.

If the platen is lowered (412, "Yes"), there is significantly greater access to the print zone and feeding the media forward into the area vacated by the platen can be effective in clearing the jam. Thus, the printer will automatically attempt to feed the media forward 257 mm (10 inches) when the platen is first lowered. The printer first determines if this automatic feed has already occurred (typically by consulting status flags stored in the printer memory) (442). If the auto feed has not occurred (422, "No") the printer automatically feed the media forward 257 mm (10 inches) (426). If the printer has previously performed this auto feed, the flag in memory is set to reflect this (422, "Yes"). The printer then waits for the user to manually pull the media through the print zone. When the user manually pulls on the media (420), the printer automatically moves the media forward into the print zone (418). These user triggered actions (416, 418, 426) by the printer will typically clear the jam or assist the user in clearing the jam. After these actions (416, 418, 426), the process loops back to block 410. If the media has been cleared from the media path (410, "No") the user can raise the platen (if needed), replace the duplex module, and close the left door (426). If the media is still present in the media path, the jam was not successfully cleared and the user triggered actions are again applied as shown in blocks 412-422 and 426.

Figure 5:
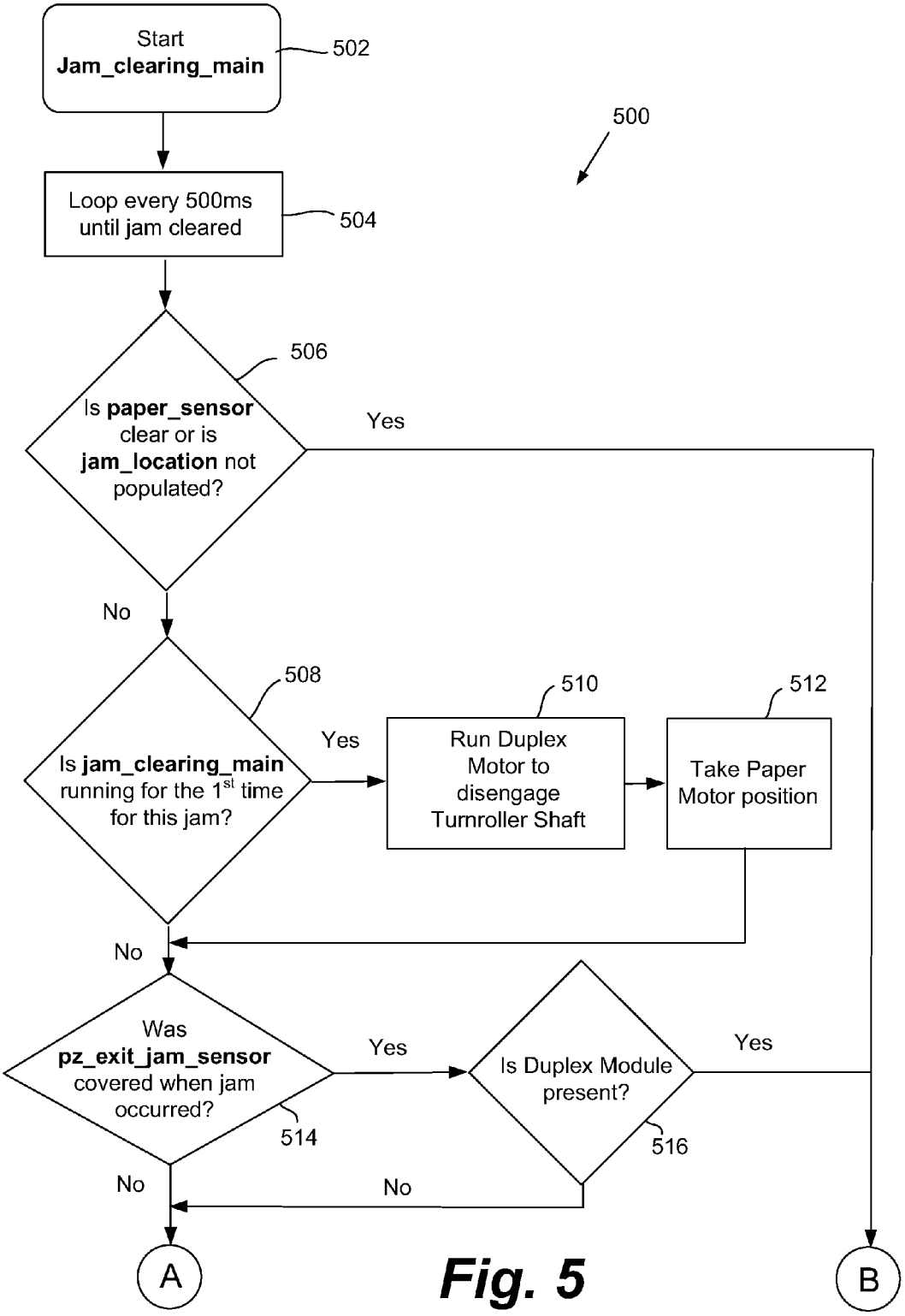
FIG. 5 is a flowchart of a process for user triggered media jam clearing, according to one example of principles described herein.
Figure 5:
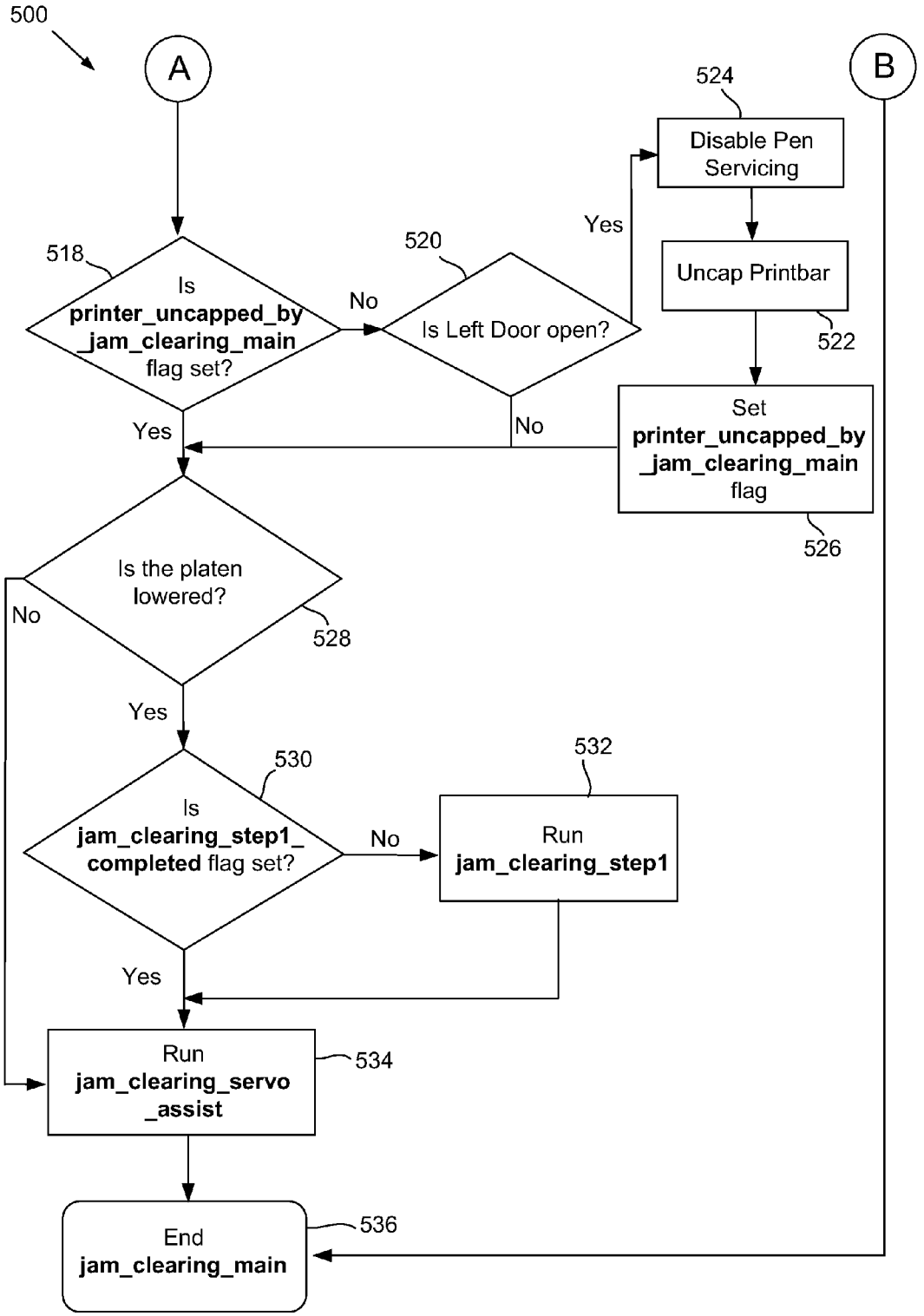

FIG. 5 is a flowchart of a "Jam_clearing_main" process (500) executed by a processor and memory that are internal to the printer. The process (500) implements the method described above in FIGS. 4A and 4B. The process "Jam_clearing_main" is started when a jam is detected (502). The process loops (restarts) every 500 milliseconds (or some other predetermined period) until the jam is cleared (504).

The printer checks to determine if a paper jam is currently present (506). This can be performed in a variety of ways, including determining if "paper_sensor" flag is clear, indicating that one or more paper sensors in the media path do not detect the presence of media in the media path. Additionally, a "jam_location" parameter may be checked. If jam_location is populated, there is a jam that is detected. In this example, if there is no media detected in the media path and there jam_location parameter does not indicate that a jam is present (506, "Yes") the process ends.

If one or more of the parameters indicates that a jam is present (506, "No"), the printer determines if the jam_clearing_main process is running for the first time. This can be tracked in a number of ways, including using a counter for the number of times the jam_clearing_main process has been executed. If this is the first time the jam_clearing_main process has run (508, "Yes"), the printer can take several steps to facilitate the clearing of the jam. In this example, the printer runs the duplex motor to disengage the turnroller shaft (510). This reduces the amount of force the user will have to exert to extract the media. The printer also records the paper motor position (512). This measurement will later be used to determine if the user is pulling on the media. After taking these or other preliminary steps to facilitate the clearing of the jam, the process returns to the main path.

If the print zone exit jam sensor was covered when the jam occurred, this indicates that leading edge of the media has already passed through the print zone and the jam is expected to be primarily in the print zone or close to the exit jam sensor. If the print zone exit jam sensor was covered when the jam occurred (514, "Yes") the printer checks to determine if the duplex module is present (516). If the duplex module is present (516, "Yes"), the platen cannot be lowered to clear the jam and the process ends. If the duplex module is not present (516 "No"), then the process returns to the main path for further action.

The printer next checks to determine if the printer_uncapped_by_jam_clearing_main flag is set. If the flag is set (518, "Yes") then the print bar is lowered to secure the media path (as shown in FIG. 3) and the jam clearing can proceed. If the print bar is not lowered (518, "No") the printer checks to determine if the left door is open (520). The access door being open (520, "Yes") indicates that a user is present and that the printer should prepare to assist the user in clearing the jam. The printer then takes the steps of disabling the pen servicing (524), uncapping the print bar (522) and setting the flag "printer_uncapped_by_jam_clearing_main" to the appropriate value (526). The process then moves back to the main path for further action.

The printer next determines if the platen is lowered (528). If the platen is not lowered (528, "No"), the printer moves immediately to run "jam_clearing_servo_assist" (534) as described below with respect to FIG. 7. However if the platen is lowered (528, "Yes"), the printer checks to determine it has run the automatic jam clearing process ("jam_clearing_step1") (530). If it has not (530, "No") the printer runs the process (532) and then returns to the main path. The jam_clearing_step1 process is described below with respect to FIG. 6. If jam_clearing_step1 has been previously run (530, "Yes"), the printer proceeds by running the process jam_clearing_servo assist (534). The jam_clearing_main then ends (536). As discussed above, jam_clearing_main will restart (loop) again after 500 milliseconds have elapsed if there is still an indication that a media jam exists in the printer.

Figure 6:
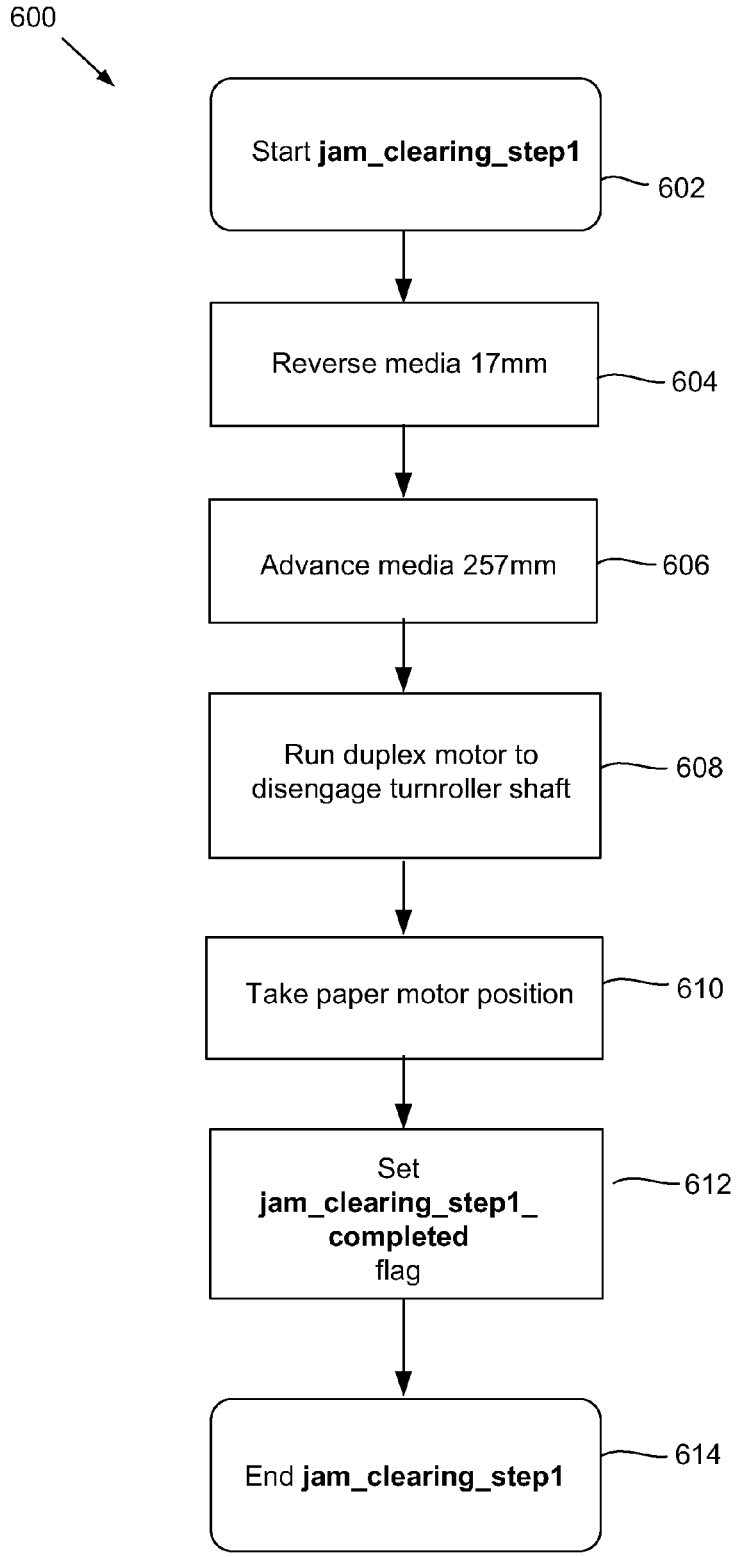
FIG. 6 is a flowchart of a method for automated media jam clearing that is triggered by user action, according to one example of principles described herein.

FIG. 6 is a flowchart (600) of a method for automated media jam clearing called "jam_clearing_step1" that is triggered by user action. Specifically, jam_clearing_step1 is executed at block 532 of FIG. 5. The prerequisite user actions for triggering jam_clearing_step1 include opening the access door (520, FIG. 5), removing the duplex module (516, FIG. 5), and lowering the platen (528, FIG. 5). This places the printer in the configuration shown in FIG. 3.

The "jam_clearing_step1" process is automatically executed by the printer (602) in response to the user actions discussed above. The user actions place the printer in a favorable state for this automated process to clear the majority of the media jams in the print zone. The "jam_clearing_step1" process is only performed once because the likelihood of a jam that was not cleared the first time being cleared by running the process a second time is slight. The process includes reversing the media a predetermined distance (604) and then advancing the media (606) a significant distance. Reversing the media a first distance can assist in clearing jams where the leading edge of the media has not correctly enter the pinch between two rollers or has been otherwise misdirected. By reversing the direction, the leading edge of the media can disengage with the obstruction and has a second chance to correctly move through the media path. In the example shown in FIG. 6, the media is reversed approximately 17 millimeters (604). The media is then advances a distance that is a significant portion of the length of the sheet of the media. This moves the media out of the print zone so that the user can easily remove it. In the example shown in FIG. 6, the distance is approximately 257 millimeters. The exact distance the media is reversed and advanced can vary between printers and with media size. The distances can be predetermined by analytically accounting for geometric factors of the media and print path, mechanical properties of the media, and other factors. In other examples, the distances can be determined experimentally.

The duplex motor is then run to disengage the turnroller shaft (608). As discussed above, this disengages rollers that provides resistance when the user tugs on the paper. The paper motor position is taken (610) and the jam_clearing_step1_completed flag is set (612). The process then ends (614). This flag is used in the main process shown in FIG. 5 at block 530.

Figure 7:
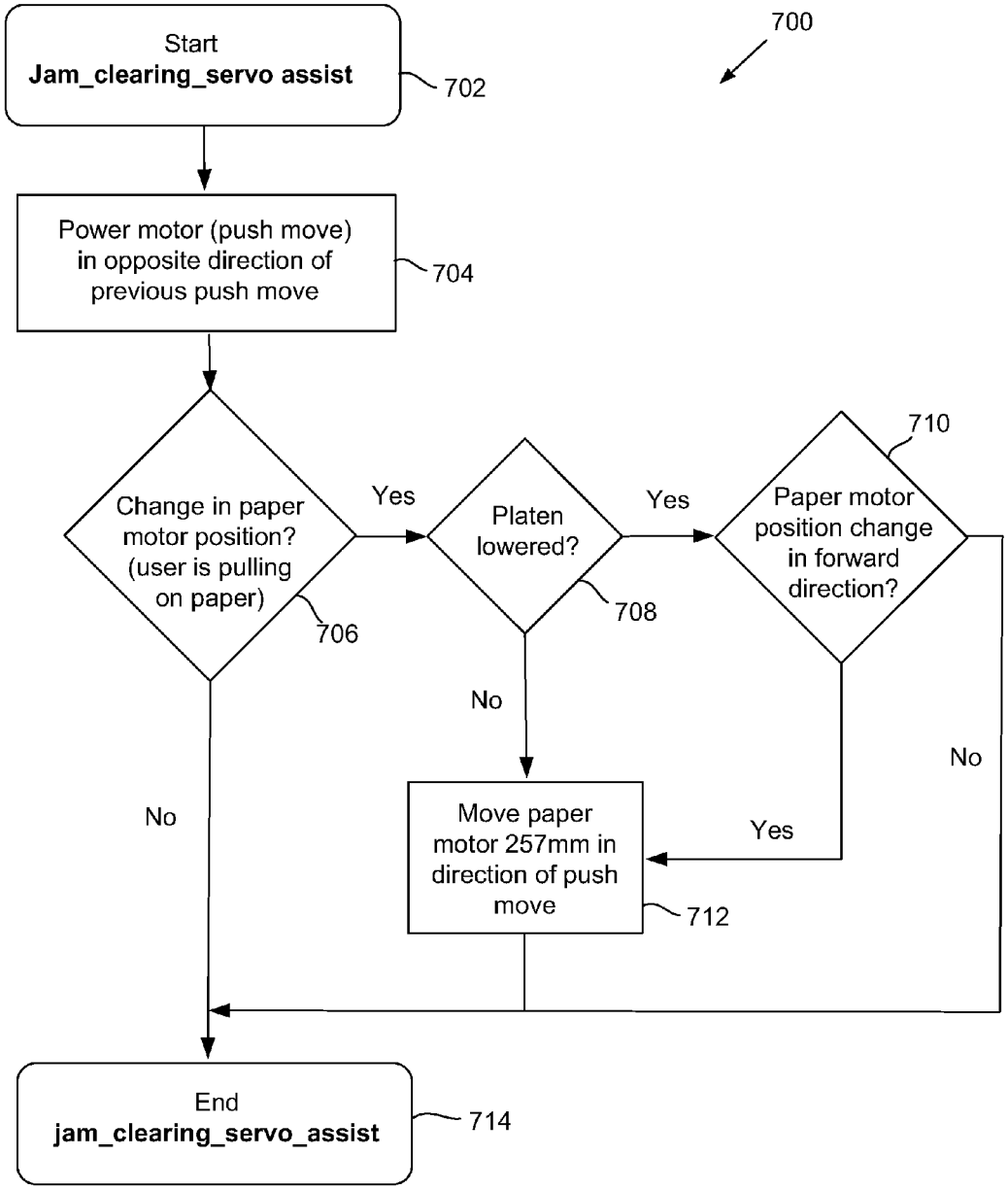
FIG. 7 is a flowchart of a method for providing automated assistance to a user extracting media from a media jam, according to one example of principles described herein.

FIG. 7 is a flowchart (700) of a method for assisting a user in extracting media from a media jam. In this example, the process "jam_clearing_servo assist" facilitates the user rotating the rollers by pulling on the media, detects the direction the user it pulling on the media, and then turns the rollers in the appropriate direction to assist the user in extracting the jammed media.

The "jam_clearing_servo assist" process is triggered in response to several user actions, including opening the access door (520, FIG. 5) and removing the duplex module (516, FIG. 5). The platen may or may not be lowered. The "jam_clearing_servo assist" process is activated (702) at block 534 in FIG. 5. The "jam_clearing_servo assist" process includes driving one or more of the electrical motors with electric current that is insufficient to actually move the roller attached to the motor but is great enough to remove a substantial portion (more than 50%) of the rover's resistance rotation. For example, the levels of electrical current can be selected to remove approximately 80% of the resistance to motion. This can greatly assist the user in extracting the jammed media without tearing it. The application of low levels of current that do not actually move the motors/gears/rollers is called a "push move." Because the printer does not know which direction the roller should move to best assist the user, the push move current are applied in a first direction for a short period of time (hundreds of milliseconds) and then reversed. Thus if a user is tugging on the paper in a forward direction and the push move current is applied in a direction that tends to move the media in a reverse direction, the media will probably not move. However, in a very short time, the current reverses and removes 80% of the resistance to forward motion. This allows the user to move the paper. The printer senses this motion by monitoring encoders on the motors or rollers. When the printer senses this motion and the direction of the motion, the printer can apply full current levels to the motors to assist the user in extracting the media. This process occurs in the same way for a user pulling the media in the reverse direction. For example, the user may be tugging on the trailing portion of the media that extends into the duplex area or paper tray. The printer can facilitate this motion by reducing the motor resistance, sensing the rearward motion, and then driving the media backward down the media path.

Returning to FIG. 7, a push move current that is opposite of the previous push move current is applied to one or more of the drive motors (704). The directions of the push move current can be tracked by setting a variable or flag in the printer memory. If the process is just being started, the push move current can be: in an arbitrary direction (polarity), in a predetermined direction, or in a direction determined by whatever value happens to be in the flag memory location. However, once the process starts, the push move current alternates direction in each new cycle. As discussed above, jam_clearing_main operates every 500 milliseconds. This means that when conditions warrant it, "jam_clearing_servo assist" will be executed every 500 milliseconds. In some examples, the push move current may be applied in a first direction for 400 milliseconds, then "jam_clearing_servo assist" ends without sensing the user tugging on the media. The "jam_clearing_servo assist" executes again in approximately 100 milliseconds, but applies a push move current that is opposite that in the previous cycle.

If the printer detects the user tugging on the media by checking for changes in the paper motor position (706, "Yes") the printer then determines if the platen is lowered (708). If the platen is lowered (708, "Yes) the printer checks to determine if the paper motor changed in the forward direction (710). If both of these conditions are met (710, "Yes"), the printer can ascertain that the print zone is open and the user is pulling on the paper from the print zone area. The printer then moves the paper motor forward a predetermined distance in the forward direction (712).

If the platen is not lowered (708, "No") the printer moves the paper motor in the direction of the current push move when the user pulling on the media was detected. As discussed above, the direction of the push move current when motion is detected will typically be in the same direction as the user is pulling. Thus, this process successfully uses alternative push move currents and the motor encoders to determine the direction the user is pulling on the media. After moving the motor in the direction the user is pulling, the process ends (714). As discussed above, if the jam is still present, the jam_clearing_main process will start again.

A printer that waits for user action to trigger automatic jam clearing provides a number of advantages. The jam is more likely to be cleared instead of aggravated when the printer waits for the user to place the printer in a more desirable state. Further, the user experience can be significantly enhanced when jams are easily cleared. The user may find that pulling jammed media out of a printer implementing the principles described above is significantly easier than other printers. The printer's removal of a significant amount of the motor/rollers rolling resistance can significantly increase the likelihood that the user can successfully clear more serious jams without ripping the media apart.

The preceding description has been presented only to illustrate and describe examples of the principles described. This description is not intended to be exhaustive or to limit these principles to any precise form disclosed. Many modifications and variations are possible in light of the above teaching.

What is claimed is:

1. A method for media jam clearing comprising:

detecting a media jam with a sensor in a printer, in which the media jam comprises media stuck in a media path of the printer;

monitoring for user action that mechanically alters a state of the printer;

in response to detection of a media jam, lifting a print bar out of a print zone;

detecting the user action that mechanically alters the state of the printer; and in response to detection of the user action, automatically attempting to clear the media jam by activating an electrical motor with an electrical current that is insufficient to move a roller of the printer.

2. The method of claim 1, further comprising, in response to detection of a media jam, capping the print bar.

3. The method of claim 2, further comprising, in response to detecting a user action, uncapping the print bar and lowering the print bar into the print zone.

4. The method of claim 1, further comprising, after detection of the media jam, automatically altering the printer configuration to facilitate user triggered jam clearing.

5. The method of claim 4, in which automatically altering the printer configuration comprises disengaging one of: a motor, a shaft, or a roller to reduce resistance to paper motion.

6. The method of claim 1, further comprising, in response to detection of a paper jam, directing the user to take specific user action.

7. The method of claim 1, in which the user action that alters the mechanical state of the printer comprises opening an access door and moving an internal module or lever.

8. The method of claim 1, in which detecting the user action that mechanically alters the state of the printer comprises detecting a user pulling on the media stuck in the media path.

9. The method of claim 1, further comprising applying a push move current to the electrical motor connected to the roller in the media path, in which the push move current is not sufficient to rotate the roller but removes a significant portion of the motor and roller resistance to rotation.

10. The method of claim 9, in which applying a push move current comprises alternating the polarity of the push move current.

11. The method of claim 9, further comprising detecting a direction in which a user pulls on the media by determining which polarity of push move current is applied when the media moves.

12. The method of claim 1, in which automatically attempting to clear the media jam comprises driving motors and rollers in the media path in a reverse direction for a first predetermined distance and then driving the motors and rollers in a forward direction a second predetermined distance.

13. The method of claim 11, in which, if the media jam is not cleared automatically, assisting a user in clearing the media jam by reducing the rotation resistance of motors and rollers in the media path.

14. A system for media jam clearing comprising:

a first sensor to:

detect a media jam in a media path of a printer; and generate a first output in response to detection of the media jam;

a second sensor to:

detect user action that mechanically alters a state of the printer; and generate a second output in response to detection of the user action; and a motor, in response to the first output, second output, and a push move current, to automatically attempt to clear the media jam by removing a portion of a rotational resistance of a roller connected to the motor, the push move current to be sufficient to remove a significant portion of resistance to rotation of the roller and insufficient to rotate the roller.

15. A method for media jam clearing comprising:

detecting a media jam, in which the media jam comprises a sheet of media stuck in a media path of the printer;

in response to detection of a media jam, lifting a print bar out of a print zone, capping the print bar, disengaging a turnover shaft to reduce resistance to paper motion and recording first motor encoder position;

automatically altering the printer configuration to facilitate user triggered jam clearing and directing the user to take a user action that mechanically alters the state of the printer, the user action comprising opening an access door and removing a duplex module;

monitoring for the user action;

detecting the user action;

in response to detecting the user action, uncapping the print bar and lowering the print bar into the print zone;

in response to detection of a second user action, automatically attempting to clear the media jam by driving motors and rollers in the media path in a reverse direction for a first predetermined distance and then driving the motors and rollers in a forward direction a second predetermined distance;

applying a push move current to an electrical motor connected to roller in a media path, in which the push move current is not sufficient to rotate the roller but removes a significant portion of the motor and roller resistance to rotation, in which the polarity of the push move current alternates as a function of time;

comparing the recorded first motor encoder position to a second motor encoder reading to detect a user pulling on the media stuck in the media path;

detecting a direction in which a user pulls on media by determining which polarity of push move current is applied when the media moves; and advancing the driving motors and rollers in the media path a predetermined amount in the direction the user pulled the media.

* * * * *